United States Patent [19]

Yuge

[11] Patent Number: 4,920,243

[45] Date of Patent: Apr. 24, 1990

[54] PUSH BUTTON SWITCH DEVICE WITH ILLUMINATING MEANS

[75] Inventor: Tadashi Yuge, Iwaki, Japan

[73] Assignee: Alps Electric Co., Ltd., Tokyo, Japan

[21] Appl. No.: 180,297

[22] Filed: Apr. 12, 1988

[30] Foreign Application Priority Data

Aug. 11, 1987 [JP] Japan ..... 62-122800[U]

[51] Int. Cl.[5] ..... H01H 9/16

[52] U.S. Cl. ..... 200/314; 200/341; 200/310

[58] Field of Search ..... 200/310, 314, 315, 339, 200/340, 341, 345

[56] References Cited

U.S. PATENT DOCUMENTS

| | | | |
|---|---|---|---|
| 3,226,520 | 12/1965 | Schuchard | 200/314 |
| 3,598,950 | 8/1971 | Ohashi | 200/315 |
| 4,343,975 | 8/1982 | Sado | 200/310 |
| 4,354,078 | 10/1982 | Yoshimura | 200/340 |
| 4,582,967 | 4/1986 | Brumit | 200/340 |

FOREIGN PATENT DOCUMENTS 2118778 11/1983 United Kingdom ..... 200/340

*Primary Examiner*—Henry J. Recla
*Assistant Examiner*—Glenn T. Barrett
*Attorney, Agent, or Firm*—Guy W. Shoup; David W. Heid

[57] ABSTRACT

A push button switch device having an illumination capability is disclosed, wherein a push button switch can be pushed with certainty at whichever portion a key top is pushed. The push button switch device includes a pair of rockable members integrally formed on a casing and each having a protective wall formed thereon. The protective walls of the rockable members are located on opposite sides of a light introducing member. A pushing member extends downwardly from the free ends of the rockable members and is located for pushing engagement with the push button switch. The key top is securely mounted at upper ends of the protective walls of the rockable members. When the key top is pushed, the rockable members are deformed downwardly by the key top so that the pushing member thereon pushes the stem of the push button switch to cause switching of the switch.

4 Claims, 2 Drawing Sheets

PUSH BUTTON SWITCH DEVICE WITH ILLUMINATING MEANS

BACKGROUND OF THE INVENTION

This invention relates to improvements in a push button switch device with an illuminating means for use with a car stereo phonograph, a car radio set and the like.

One of conventional push button switch devices of the type mentioned is disclosed, for example, in Japanese Utility Laid-Open No. 61-48620. In the disclosed device, a light introducing member made of a transparent material such as an acrylic resin is placed on a printed circuit board on which a push button switch is mounted, and a key top is supported for rocking motion on the light introducing member by way of a connecting member. The light introducing member is designed to introduce light emitted from a light source to illuminate an indicating portion of the key top. In use, if the key top is pushed by a finger of an operator, part of the key top pushes the push button switch to cause switching of the push button switch.

In the conventional push button switch device with an illuminating means, a lower portion of the key top is hinged to an upper face of the light introducing member by way of a connecting member. Accordingly, there is a problem that switching of the switch may not be assured because, in case the key top is pushed at a portion near above the hinged portion thereof, the pushing force may concentrate on the connecting member and consequently the key top may not be moved down by a desired distance. It is a matter of course that, if the switch is located in a centered relationship to the key top, it can be pushed with certainty at whichever portion the key top is pushed. However, since the push button switch device with an illuminating means is constructed such that the light introducing member is located behind the key top, another means is required to attain an assured operation of the push button switch device.

SUMMARY OF THE INVENTION

Accordingly, it is an object of the present invention to provide a push button switch device with an illuminating means which resolves such a technical problem of the conventional push button switch device as described above and wherein a push button switch can be pushed with certainty at whichever portion a key top is pushed.

In order to attain the object, according to the present invention, there is provided a push button switch device of the type wherein a light introducing member for introducing light from a light source is located behind a key top which causes, when pushed, switching of a push button switch, comprising a casing, a pair of rockable members formed in an integral relationship on an inner wall of the casing and each having a protective wall formed thereon, the protective walls of the rockable members being located on opposite sides of the light introducing member, a pushing member connecting free ends of the rockable members to each other and extending downwardly from the free ends of the rockable member, wherein the pushing member is located for pushing engagement with the push button switch, and the key top being securely mounted at upper ends of the protective walls.

With the push button switch device, if the key top is pushed, the rockable plates are deformed downwardly by the key top so that the pushing member pushes the stem of the push button switch. Since the rockable members extend in a horizontal direction from the inner wall of the casing, that is, in a direction perpendicular to the direction of the pushing force to the key top, the pushing member of the rockable members is moved down by a small pushing force irrespective of a location at which the key top is pushed. Accordingly, a switching operation of the push button switch can be effected with certainty.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
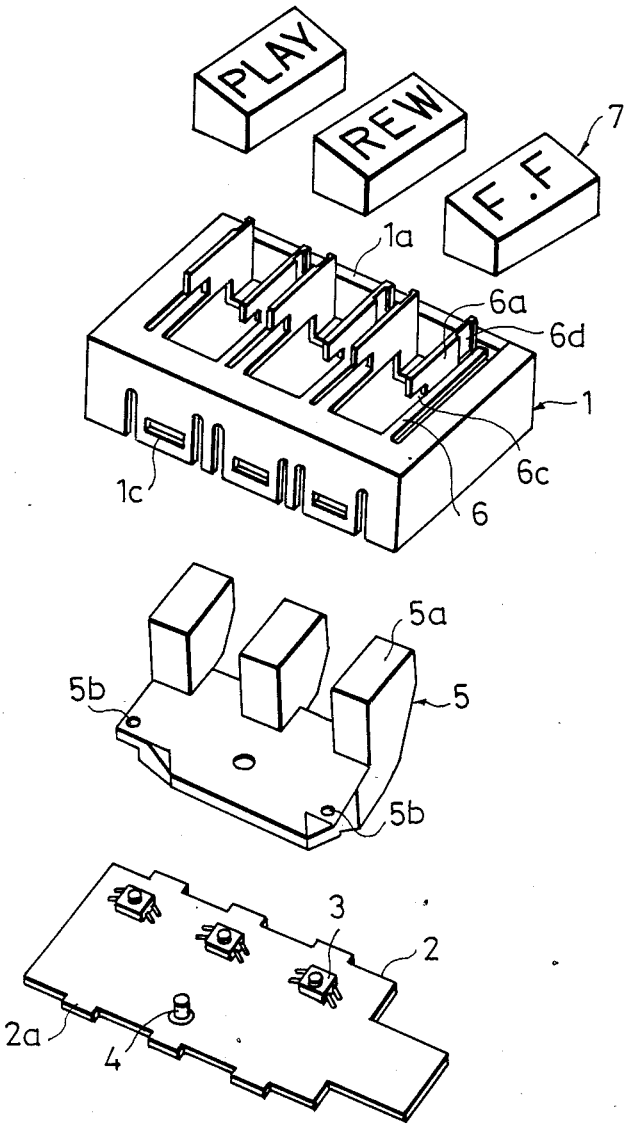
FIG. 1 is a fragmentary perspective view of a push button switch device with an illuminating means showing a preferred embodiment of the present invention.
Figure 3:
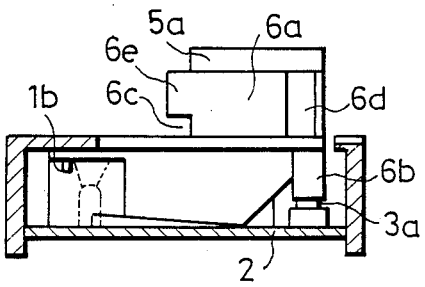
FIG. 3 is a sectional view taken along line A—A of FIG. 2.
Figure 4A:
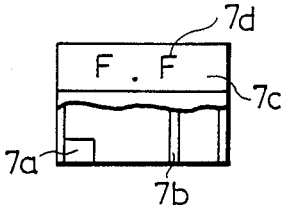
FIG. 4(A) is a front elevational view of a key top of the push button switch device of FIG. 1.
Figure 4B:
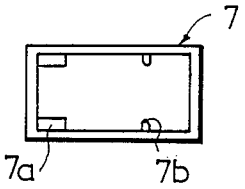
FIG. 4(B) is a bottom plan view of the key top of FIG. 4(A).

In FIG. 1, a push button switch device with an illuminating means according to the present invention includes a casing 1 made of a synthetic resin material, and a printed circuit board 2 securely mounted at a lower end of the casing 1. The push button switch device further includes up to 3 push button switches 3 soldered to the printed circuit board 2. When the pushing force is applied to one of the push button switches 3 from above, the push button switch 3 is switched from an off state to an on state. A single light source 4 which may be an LED (light emitting diode), a lamp or the like is also soldered to the printed circuit board 2. A light introducing member 5 made of a transparent material such as an acrylic resin is placed on and secured to the printed circuit board 2 in such a manner as to surround the light source 4. Meanwhile, a pair of rockable members 6 each in the form of cantilever are provided for each of the push button switches 3 and extend in a parallel relationship to each other in a horizontal direction from the top of an inner face of a side wall of the casing 1. A protective wall **6*a* is formed on and extends vertically up from a free end of each of the rockable members 6 for the purpose of attaching a key top, and a pushing member 6*b*, as shown in FIG. 3, is formed between and extends downwardly from the free ends of the rockable members 6 in each pair. Each of the protective walls 6*a* of the rockable members 6 has a recess 6*c* formed therein for engaging with a corresponding one of a pair of block pieces 7*a*, as illustrated in FIGS. 4(A) and 4(B) provided on an inner bottom wall of each of up to 3 key tops 7 which are provided for the push button switches 3. Each of the protective walls 6*a* further has a sliding recess 6*d* formed on a side face thereof for sliding engagement, when a corresponding one of the key tops 7 is assembled, by an engaging projection or rib 7*b*** formed on an inner face of a side wall of the key top 7. Each of the key tops 7 has an inclined operating face 7c having a light transmitting property on which a desired indicating pattern 7d is formed by applying opaque ink to part of a base of, for example, a transparent synthetic resin material. The light introducing member 5 has 3 upwardly extending light introducing portions, and upper ends 5a of the light introducing portions are located just below the operating faces 7c of the key tops 7 while the protective walls 6a in each pair are located on opposite sides of a corresponding one of the light introducing portions of the light introducing members 5.

A process of assembling the push button switch device with an illuminating means having such a construction as described above will now be described.

Figure 2:
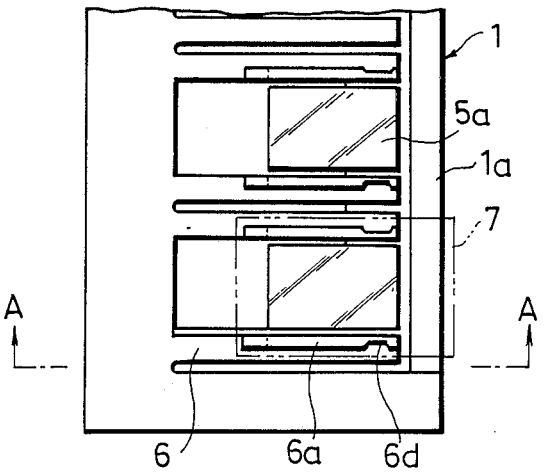
FIG. 2 is a plan view showing the push button switch device of FIG. 1 in an assembled condition with key tops removed.

Referring to FIG. 1, the light introducing member 5 is fitted into the casing 1 from below such that the upper ends 5a of the former may be located above the pushing members 6b of the latter and a pair of projections 1b as illustrated in FIG. 3 provided on an inner wall of the casing 1 may be fitted into a corresponding pair of holes 5b formed in the light introducing member 5. Then, the printed circuit board 2 is assembled to the casing 1 such that a plurality of arresting pieces 2a formed on the former may be fitted in a corresponding plurality of slots 1c formed on opposite side walls of the casing 1. Subsequently, the key tops 7 are inserted into the casing 1 from above such that the block pieces 7a of the key tops 7 may not contact with end portions 6e of the protective walls 6a of the rockable members 6, thereby assembling the key tops 7 to the rockable members 6. After then, the key tops 7 are slidably moved to such a position as indicated in long and short dash lines in FIG. 2 in which the block pieces 7a of the former are engaged with the recesses 6c of the rockable members 6. Further, during such sliding movement of the key tops 7, the engaging projections 7b thereof are slidably moved in the sliding recesses 6d of the protective walls 6a of the rockable members 6 until they are engaged with one side faces of the sliding recesses 6d. Thus, assembly of the push button switch device is completed.

With the push button switch device of the construction described above, if one of the key tops 7 is pushed, the corresponding rockable members 6 extending from the casing 1 are rocked around their respective fulcrums provided by the root portions thereof so that the pushing member 6b provided at the free ends thereof is moved downwardly to push down the stem 3a of the corresponding push button switch 3, as illustrated in FIG. 3. Consequently, internal contacts of the push button switch 3 are contacted with each other to turn the switch 3 on. Then, if the pushing force is removed from the key top, the initial condition of the push button switch device is restored by the elastic restoring force of the internal contacts of the push button switch 3 and the rockable members 6a.

It is to be noted that, since end portions 1a of the casing 1 which are located below the key tops 7 are formed in a offset condition, a lower face of a key top 7 will not, when pushed, be contacted with the corresponding end portion 1a of the casing 1, and accordingly, depressing the key top 7 will not damage the casing 1, cause the key top 7 to be stuck in the on position, or prevent the key top 7 from causing the switch to turn on.

Further, while nothing is placed on an upper face of the casing in the present embodiment, where the push button switch device is mounted on an operation panel, a cover member may be placed in such a manner as to cover the push button switch device except the key tops.

Having now fully described the invention, it will be apparent to one of ordinary skill in the art that many changes and modifications can be made thereto without departing from the spirit and scope of the invention as set forth herein.

What is claimed is:

1. A push button switch device comprising:
a casing having a plurality of walls;
a pair of rockable members formed in an integral relationship with said casing, each of said rockable members extending from a first wall of said casing in a cantilever relationship with said first wall and each of said rockable members terminating in a free end, the free end of each rockable member including a protective wall extending vertically up from said free ends;
a pushing member connecting said free ends of said rockable members;
a key top supported on said protective walls;
a circuit board affixed to said casing and being positioned below and adjacent to said pushing member;
a switch means mounted on said circuit board below said pushing member in an operative relationship with said pushing member such that when said key top is pushed, the deflection of said rockable members causes said pushing member to activate said switch means;
a light introducing member positioned above said circuit board and within said casing, said light introducing member having a portion which extends between said pushing member and under said key top to introduce light to said key top; and
a light source mounted on said circuit board in an operative relationship with said light introducing member, whereby light from the light source is conducted to said key top through said light introducing member.

2. A push button switch device according to claim 1, wherein each of said protective walls of said rockable members has a recess formed therein while said key top has a pair of block pieces formed on an inner bottom wall thereof for engagement with the recesses of said rockable members.

3. A push button switch device according to claim 1, wherein each of said protective walls of said rockable members has a sliding groove formed on a side face thereof while said key top has a pair of engaging projections formed on inner faces of opposite side walls thereof for sliding engagement with the sliding grooves of said rockable members.

4. A push button switch device according to claim 1, wherein said light introducing member is made from a transparent material, the key top includes a hollow portion and the portion of said light introducing member extending under said key top is shaped to fit within said hollow portion of said key top to bring light from said light source to the undersurface of said key top.

* * * * *